US006382013B1

(12) United States Patent
Zarkhin et al.

(10) Patent No.: US 6,382,013 B1
(45) Date of Patent: May 7, 2002

(54) METHOD OF READING AN OXYGEN SENSOR INPUT

(75) Inventors: Mikhail Zarkhin, West Bloomfield; Timothy P Philippart, Royal Oak; Daniel B Ciesinski, White Lake; Vasil Germanski, Washington; Mark J Stachew, Fenton, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/569,415

(22) Filed: May 12, 2000

(51) Int. Cl.[7] ..... F02M 7/00; F02D 35/00; F02D 41/14; F02B 33/00; F02B 3/00

(52) U.S. Cl. ..... 73/23.31; 73/23.21; 73/31.05; 123/489; 204/406; 204/412; 422/98

(58) Field of Search ..... 73/23.31, 23.32, 73/31.05, 23.21; 422/98, 94, 83; 204/406, 412, 425, 410; 123/489, 32 EE, 32 EC, 32 EA, 693, 440, 119

(56) References Cited

U.S. PATENT DOCUMENTS 4,075,982 A * 2/1978 Asano et al. ..... 123/32 EH
4,130,095 A * 12/1978 Bowler et al. ..... 123/32 EE
4,138,979 A * 2/1979 Taplin ..... 123/119 EC
4,197,767 A * 4/1980 Leung ..... 74/860
4,214,563 A * 7/1980 Hosaka ..... 123/437
4,307,450 A * 12/1981 Carp et al. ..... 364/431.05
4,344,317 A * 8/1982 Hattori et al. ..... 73/23
4,698,209 A * 10/1987 Hashimoto et al. ..... 422/88
4,915,813 A * 4/1990 Nakajima et al. ..... 204/406
4,981,125 A * 1/1991 Kato et al. ..... 123/440
5,211,154 A * 5/1993 Brandt ..... 123/693
5,255,661 A 10/1993 Nankee, II et al. ..... 123/674
5,270,009 A * 12/1993 Nakamori et al. ..... 422/83
5,429,105 A * 7/1995 Bennett et al. ..... 123/693
5,498,986 A 3/1996 Manlove ..... 327/77
5,569,838 A * 10/1996 Broedel et al. ..... 73/23.31
5,629,473 A * 5/1997 Hayami ..... 73/23.31
5,691,464 A * 11/1997 Cao ..... 73/23.31
6,004,201 A * 12/1999 Rump ..... 454/75
6,060,991 A * 5/2000 Hsieh ..... 340/632

* cited by examiner

*Primary Examiner*—Hezron Williams
*Assistant Examiner*—David J. Wiggins
(74) *Attorney, Agent, or Firm*—Ralph E. Smith

(57) ABSTRACT

An adjustment circuit and method for reading a measurement output of an automotive oxygen sensor provide correction for outgassing of the sensor and inversion of the measurement output. The adjustment circuit includes a biasing stage connected to a sensor return of the oxygen sensor, where the biasing stage applies a predetermined bias voltage to the sensor return. An input stage is connected to an output of the sensor for retrieving the measurement output from the sensor. The adjustment circuit further includes an A/D conversion system connected to the input stage for adjusting the measurement output based on the bias voltage. The A/D conversion system may further be connected to the biasing stage for retrieving a sensor return output from the sensor. In such cases, a differential module calculates a difference between the sensor return output and the measurement output. The sensor return output defines an actual bias voltage applied to the sensor return.

13 Claims, 4 Drawing Sheets

METHOD OF READING AN OXYGEN SENSOR INPUT

BACKGROUND OF THE INVENTION

1. Field of the Invention

The present invention relates generally to oxygen sensors. More particularly, the present invention relates to an adjustment circuit for adjusting a measurement output of an automotive oxygen sensor.

2. Discussion of the Related Art

In the automotive industry, many design issues such as engine efficiency and emissions control present substantial challenges to scientists and engineers. A particular parameter of interest relating to the above design issues is the oxygen ($O_2$) level of the automotive exhaust. It is therefore common to install one or more oxygen sensors into the manifold of vehicles at locations where exhaust from all cylinders has merged in an effort to monitor the oxygen level of the exhaust. The resulting analog signal from each sensor corresponds to a detected oxygen level and is typically fed to an A/D converter, and then to an engine controller for processing. The A/D converter transforms the analog signal into a digital value and the engine controller uses the digital value to perform many functions throughout the vehicle. Under normal operating conditions, the result is a closed loop control system for maintaining a desired engine efficiency and oxygen level in the exhaust.

It is well known that modern day oxygen sensors have a measurement output and a sensor return. A typical oxygen sensor will have a measurement output range of 0 to 1 volts relative to the sensor return. Conventional circuits connect the sensor return to ground, and apply the measurement output directly to the A/D converter. A difficulty associated with this approach, however, relates to the fact that oxygen sensors have the tendency to invert when the temperature of the sensor reaches a given temperature threshold. It can be shown that the inversion is typically due to outgassing. Thus, at very hot temperatures the measurement output will invert, resulting in a voltage between 0 and −1 volts relative to the sensor return. It is important to note, however, that the absolute value of the measurement output is still accurate. Nevertheless, the effective sensor voltage range is −1 to +1 volts.

The above inversion phenomenon causes a number of operational difficulties. For example, the typical embedded controller will have an A/D converter with an input range of 0 to 5 volts, thereby representing only positive voltages. Thus, when the measurement output inverts, the operation range of the converter is breached and the engine controller will essentially ignore the output of the A/D converter. The result is an open loop control system with respect to automotive exhaust oxygen levels. The open loop system causes poor engine efficiency and emissions control. It is therefore desirable to provide an adjustment circuit and method for adjusting a measurement output of an automotive oxygen sensor such that inversion of the measurement output does not result in open loop control.

It is also important to note that since the A/D converter has a range of 0 to 5 volts as opposed to the 0 to 1 volt range of the measurement output, the A/D converter's effective resolution is reduced by 80%. Furthermore, the relatively small measurement output of the sensor causes the signal-to-noise ratio (SNR) to become a very important issue. In order to improve the accuracy of the overall system, conventional approaches involve dedicating a separate ground reference to the sensor return. It is therefore desirable to provide an approach to maximizing the operational range of the A/D converter in view of the significantly narrower sensor voltage range.

SUMMARY OF THE INVENTION

The above and other objectives are provided by an adjustment circuit and method in accordance with the present invention for reading a measurement output of an automotive oxygen sensor. The adjustment circuit includes a biasing stage connected to a sensor return of the oxygen sensor, where the biasing stage applies a predetermined bias voltage to the sensor return. An input stage is connected to an output of the sensor for retrieving the measurement output from the sensor. The adjustment circuit further includes an A/D conversion system connected to the input stage for adjusting the measurement output based on the bias voltage. The A/D conversion system may further be connected to the biasing stage for retrieving a sensor return output from the sensor. The sensor return output defines an actual bias voltage applied to the sensor return. In such cases, a differential module calculates a difference between the sensor return output and the measurement output.

The present invention also provides a method for reading a measurement output of an automotive oxygen sensor, where the oxygen sensor has a sensor return. The method includes the steps of applying a predetermined bias voltage to the sensor return, and retrieving the measurement output from sensor. The measurement output is then adjusted based on the bias voltage.

Further in accordance with the present invention, a method for adjusting an oxygen sensor measurement output based on a predetermined bias voltage applied to a sensor return is provided. The method includes the step of determining an adjusted output based on the bias voltage and the measurement output. An absolute value of the adjusted output is then calculated, where the absolute value corresponds to a detected oxygen level. The method further includes the step of generating a digital value based on the absolute value, where the digital value corresponds to a detected oxygen level. Use of a bias voltage allows correction for outgassing of the oxygen sensor. The result is a more effective engine control loop with respect to oxygen levels.

Further objectives, features and advantages of the invention will become apparent from a consideration of the following description and the appended claims when taken in connection with the accompanying drawings.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
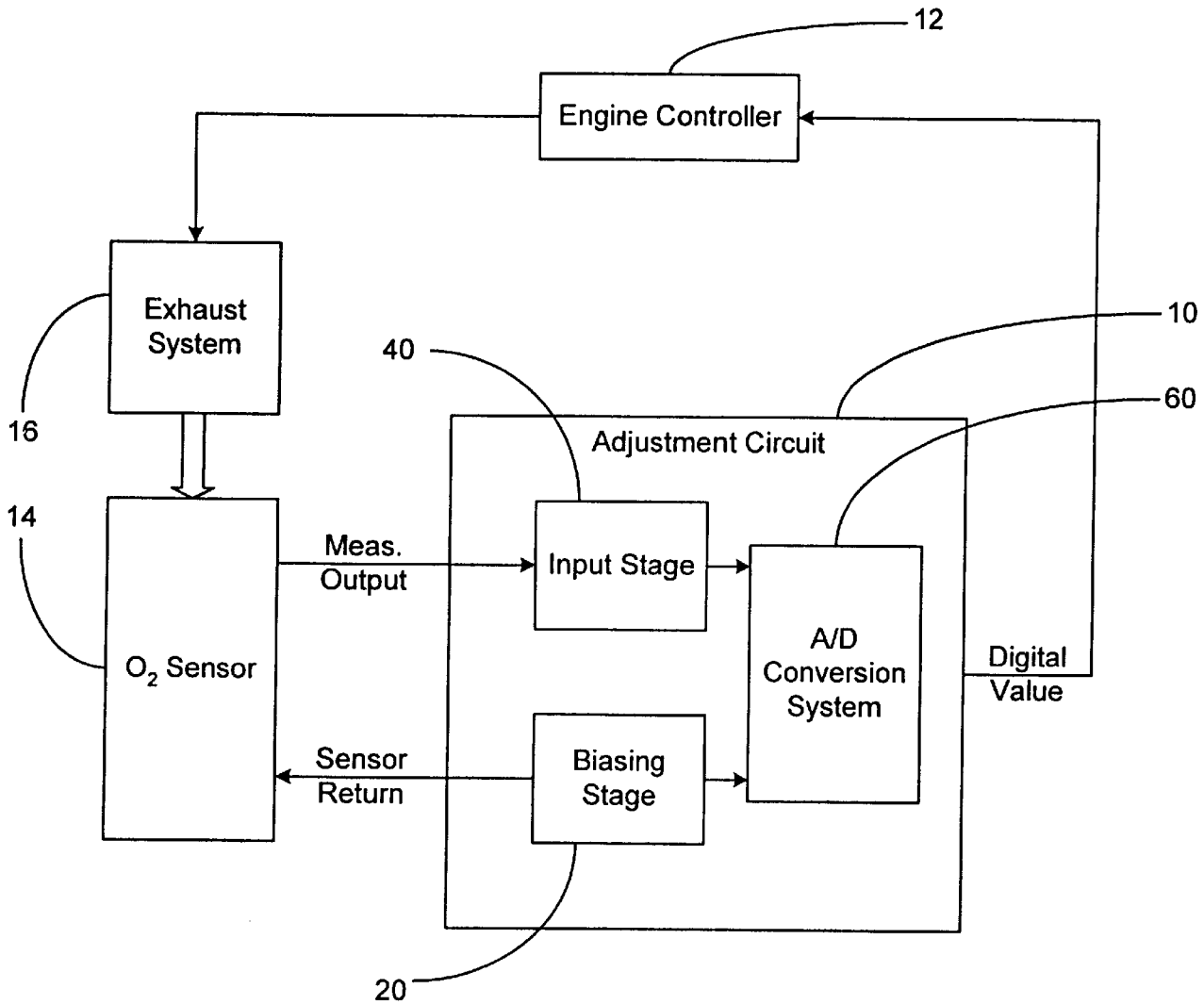
FIG. 1 is a block diagram of an adjustment circuit for reading a measurement output of an automotive oxygen sensor in accordance with the present invention.

FIG. 1 is a block diagram of an adjustment circuit 10 in accordance with the present invention. Generally, the adjustment circuit 10 retrieves the necessary information from oxygen ($O_2$) sensor 14 to provide the engine controller 12 with digital values representing detected oxygen levels. The engine controller 12 can use the digital values to control the exhaust system 16 in a closed loop fashion. It can be seen that the conventional oxygen sensor 14 has a sensor return and a temperature dependent measurement output. It can further be seen that the adjustment circuit 10 has a biasing stage 20 connected to the sensor return of the oxygen sensor, where the biasing stage applies a predetermined bias voltage to the sensor return. An input stage 40 is connected to an output of the sensor 14 for retrieving the measurement output from the sensor 14. The adjustment circuit 10 further includes an A/D conversion system 60 connected to the input stage 40 for adjusting the measurement output based on the bias voltage applied by the biasing stage 20.

Figure 2:
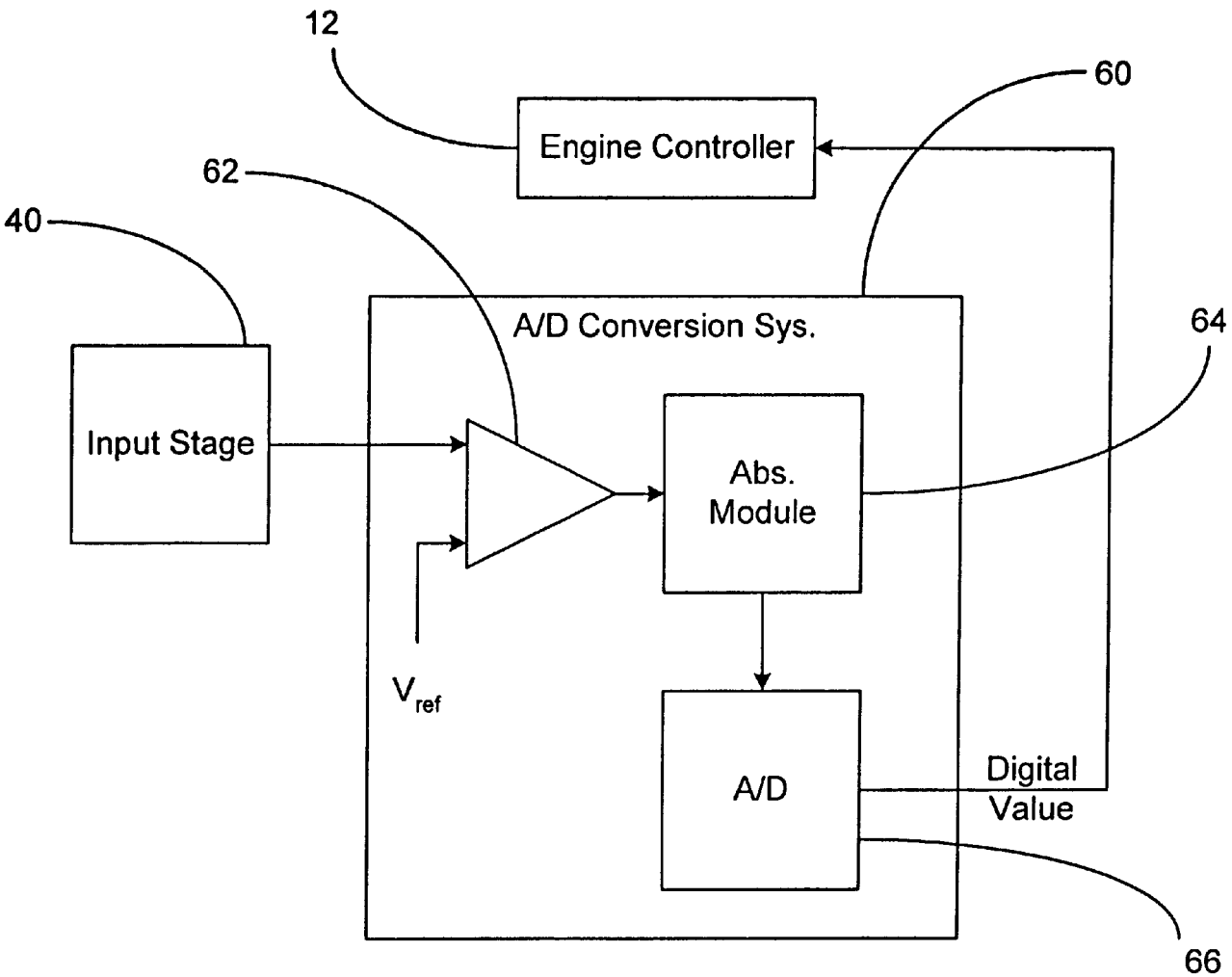
FIG. 2 is a block diagram of an A/D conversion system in accordance with one embodiment of the present invention.

Turning now to FIG. 2, one embodiment of the A/D conversion system 60 is shown in greater detail. It will be appreciated that the A/D conversion system 60 can be implemented via any number of hardware and/or software approaches well known in the art. The embodiment shown therefore represents only one of these approaches. Specifically, it can be seen that the A/D conversion system 60 includes a differential module 62 and generates an adjusted output based on the bias voltage ($V_{ref}$) and the measurement output. The conversion system 60 further includes an absolute value module 64 for generating a signal representing an absolute value of the adjusted output. An A/D converter 66 generates a digital value based on the absolute value, where the digital value corresponds to the detected oxygen level. It can be seen in this embodiment, that the differential module 62 calculates a difference between $V_{ref}$ and the measurement output. Here, $V_{ref}$ is a known value which can be incorporated into the software implementation of the A/D conversion system 60. As will be discussed in greater detail below, however, certain improvements can be made over the illustrated embodiment.

Figure 3:
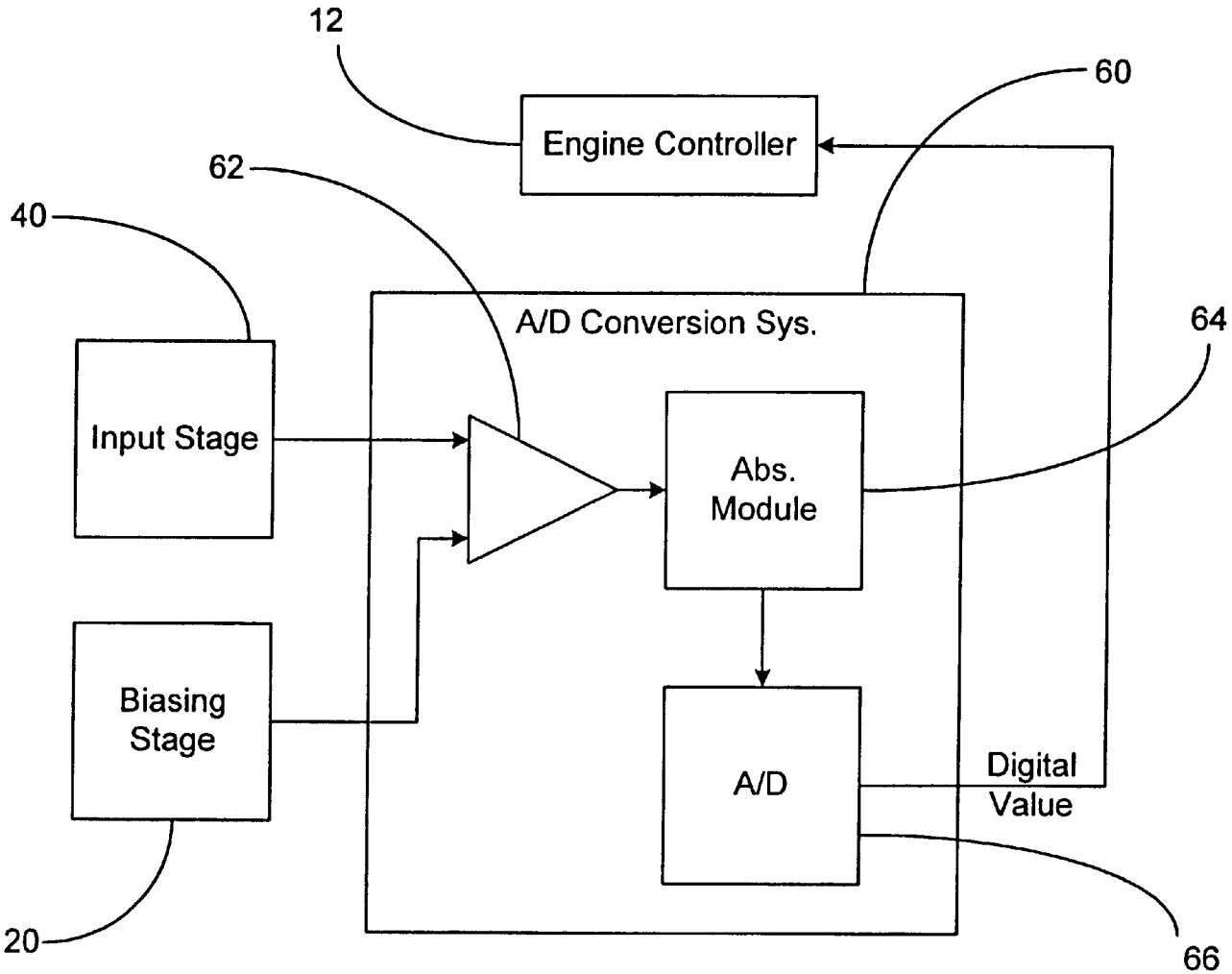
FIG. 3 is a block diagram of an A/D conversion system in accordance with a preferred embodiment of the present invention.

FIG. 3 demonstrates a highly preferred embodiment whore the A/D conversion system 60 is further connected to the biasing stage 20 for retrieving a sensor return output (i.e. the actual applied bias voltage) from the sensor 14. In such cases, the differential module 62 calculates a difference between the sensor return output and the measurement output. This allows the A/D conversion system 60 to take discrete readings of the measurement output without falling subject to component inaccuracies and associated fluctuations in the actual bias voltage applied to the sensor return.

Figure 4:
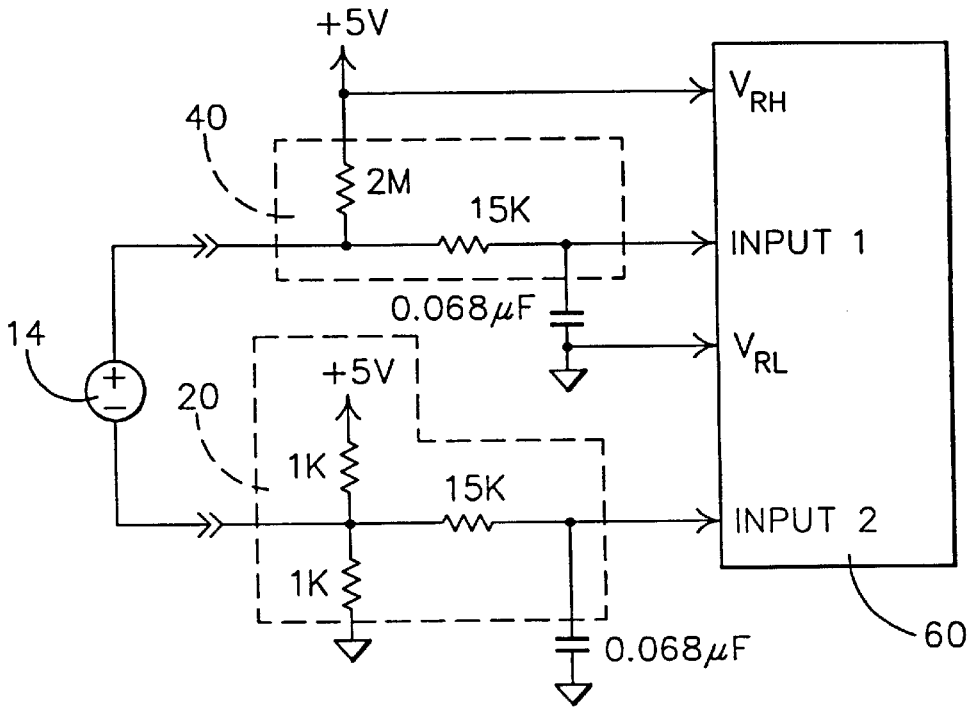
FIG. 4 is a circuit schematic of an adjustment circuit for reading a measurement output of an automotive oxygen sensor in accordance with the preferred embodiment of the present invention.

Turning now to FIG. 4, an implementation of the preferred embodiment of the present invention is shown. Specifically, it can be seen that the biasing stage 20 includes a voltage divider network for establishing a 2.5 volt voltage bias. Thus, the two 1K resistors create a 50% voltage division of the 5 volt power supply, resulting in 2.5 volts at the sensor return. As already noted, however, and as is typically the case, resistor tolerances and offsets due to the sensor leakage currents will cause the sensor return potential to deviate from 2.5 volts. Since the software implementation of the differential module 62 is written to subtract a fixed 2.5 volts under the embodiment of FIG. 2, inaccuracies may result. To rectify this, under the preferred embodiment the sensor return is routed to a separate A/D input. The software can then take discrete readings of both the measurement output and the sensor ground at inputs 1 and 2, respectfully, and calculate the absolute value of the differential voltage between the two inputs. The result is a much more accurate reading, which results in enhanced engine control.

It is important to note that the sensor 14 has a corresponding sensor voltage range (i.e. −1 to +1 volts) and that the predetermined bias voltage (2.5 volts) therefore shifts the sensor voltage range into a desired range (1.5 to 3.5 volts). The desired range therefore represents positive voltages regardless of whether the sensor 14 has inverted. Furthermore, the A/D conversion system 60 has a corresponding converter voltage range (0 to 5 volts), where the converter voltage range includes the desired range. The bias voltage allows maximization of the operational range of the A/D converter. Therefore, in cases where the measurement output inverts because a temperature of the sensor 14 has reached a given temperature threshold, a valid digital value can still be transmitted to the engine controller 12.

Figure 5:
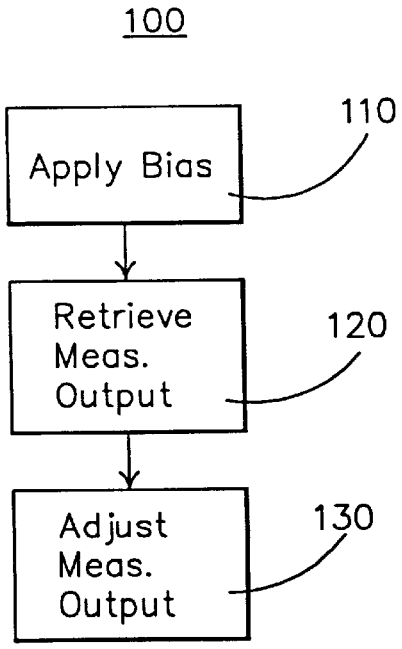
FIG. 5 is a flowchart of a method for adjusting a measurement output of an automotive oxygen sensor in accordance with the present invention.
Figure 6:
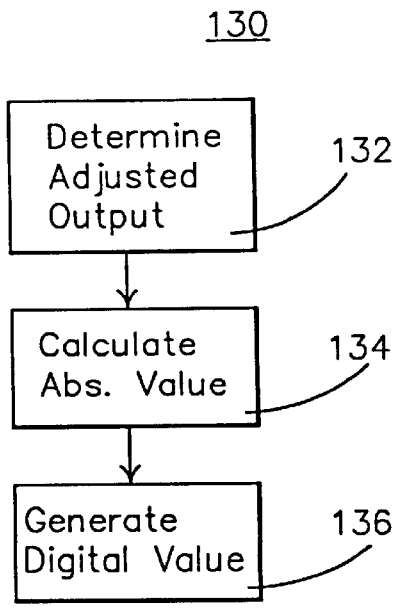
FIG. 6 is a flowchart of a method for adjusting an oxygen sensor measurement output based on a predetermined bias voltage applied to a sensor return.

Turning now to FIG. 5, a method 100 for reading a measurement output of an automotive oxygen sensor is shown for programming purposes. It can be seen that the method 100 includes the step 110 of applying a predetermined bias voltage to a sensor return of the oxygen sensor. The measurement output is retrieved from the sensor at step 120, and the measurement output is adjusted based on the bias voltage at step 130. The result is a digital value representing a detected oxygen level. FIG. 6 demonstrates a preferred approach to the step 130 of adjusting the measurement output. Specifically, it can be seen that at step 132 an adjusted output is determined based on the bias voltage and the measurement output. An absolute value of the adjusted output is calculated at step 134, and at step 136 a digital value is generated based on the absolute value. As already discussed, the digital value corresponds to a detected oxygen level.

It is to be understood that the invention is not limited to the exact construction illustrated and described above, but that various changes and modifications may be made without departing from the spirit and scope of the invention as defined in the following claims.

What is claimed is:

1. A method for reading a measurement output of an automotive oxygen sensor where the oxygen sensor has a sensor return, the method comprising the steps of:

applying a predetermined bias voltage to the sensor return;

retrieving the measurement output from the sensor;

adjusting the measurement output based on the bias voltage; and wherein the measurement output is temperature dependent and the measurement output inverts when a temperature of the sensor reaches a temperature threshold.

2. The method of claim 1 further including the steps of:

determining an adjusted output based on the bias voltage and the measurement output;

calculating an absolute value of the adjusted output; and generating a digital value based on the absolute value, the digital value corresponding to a detected oxygen level.

3. The method of claim 2 further including the step of subtracting the bias voltage from the measurement output.

4. The method of claim 2 further including the steps of:

retrieving a sensor return output from the sensor, the sensor return output defining an actual bias voltage applied to the sensor return; and subtracting the sensor return output from the measurement output.

5. The method of claim 1 wherein the sensor has a corresponding sensor voltage range, the predetermined bias voltage shifting the sensor voltage range into a desired range.

6. The method of claim 5 wherein the desired range represents positive voltages.

7. The adjustment circuit of claim 1 wherein the measurement output inverts when a temperature of the sensor reaches a temperature threshold.

8. An adjustment circuit for reading a measurement output of an automotive oxygen sensor, the adjustment circuit comprising:

a biasing stage connected to a sensor return of the oxygen sensor, the biasing stage applying a predetermined bias voltage to the return sensor;

an input stage connected to an output of the sensor for retrieving the measurement output from the sensor; and an A/D conversion system connected to the input stage and biasing stage for adjusting the measurement output based on the bias voltage, the A/D conversion system including:

a differential module for generating an adjusted output based on the bias voltage and the measurement output;

an absolute value module for generating an absolute value of the adjusted output; and an A/D converter for generating a digital value based on the absolute value, the digital value corresponding to a detected oxygen level; and wherein A/D conversion system is further connected to the biasing stage for retrieving a sensor return output from the sensor, the sensor return output defining an actual bias voltage applied to the sensor return, the differential module calculating a difference between the sensor return output and the measurement output.

9. The adjustment circuit of claim 8 wherein the A/D conversion system includes:

a differential module for generating an adjusted output based on the bias voltage and the measurement output;

an absolute value module for generating an absolute value of the adjusted output; and an A/D converter for generating a digital value based on the absolute value, the digital value corresponding to a detected oxygen level.

10. The adjustment circuit of claim 9 wherein the differential module calculates a difference between the bias voltage and the measurement output.

11. The adjustment circuit of claim 8 wherein the biasing stage includes a voltage divider network.

12. The adjustment circuit of claim 8 wherein the sensor has a corresponding sensor voltage range, the predetermined bias voltage shifting the sensor voltage range to a desired range, the desired range representing positive voltages.

13. An adjustment circuit for reading a measurement output of an automotive oxygen sensor, the adjustment circuit comprising:

a biasing stage connected to a sensor return of the oxygen sensor, the biasing stage applying a predetermined bias voltage to the return sensor;

an input stage connected to an output of the sensor for retrieving the measurement output from the sensor; and an A/D conversion system connected to the input stage and biasing stage for adjusting the measurement output based on the bias voltage, wherein the sensor has a corresponding sensor voltage range, the predetermined bias voltage shifting the sensor voltage range to a desired range, the desired range representing positive voltages and the A/D conversion system has a corresponding converter voltage range, the converter voltage range including the desired range.

* * * * *